US006958440B2

(12) United States Patent
Yu-Hwa

(10) Patent No.: US 6,958,440 B2
(45) Date of Patent: Oct. 25, 2005

(54) ADJUST DEVICE FOR ADJUSTING A TENSION OF A SNARE OF A SNARE DRUM

(76) Inventor: Lo Su Yu-Hwa, 4F.-8, No. 123, Sec. 3, Taijunggang Rd., Shituen Chiu, Taichung City 407 (TW)

( * ) Notice: Subject to any disclaimer, the term of this patent is extended or adjusted under 35 U.S.C. 154(b) by 0 days.

(21) Appl. No.: 10/802,833

(22) Filed: Mar. 18, 2004

(65) Prior Publication Data

US 2005/0204895 A1 Sep. 22, 2005

(51) Int. Cl.[7] ..... G10C 3/00

(52) U.S. Cl. ..... 84/415; 84/417

(58) Field of Search ..... 84/411 R, 415–417, 84/420, 421

(56) References Cited

U.S. PATENT DOCUMENTS 6,534,698 B2 * 3/2003 Hoshino ..... 84/415
2002/0083817 A1 * 7/2002 Hoshino ..... 84/415

* cited by examiner

*Primary Examiner*—Kimberly Lockett

(57) ABSTRACT

An adjust device for adjusting a tension of a snare of a snare drum includes a body laterally secured on a periphery of the snare drum. A slider is movably received in the body and one end of the snare is secured on the slider so that the tension of the snare is adjusted when the slider is moved. An adjuster is partially screwed into the body for adjusting the stroke of the slider. An actuated device includes a shaft having a first end extending through the adjuster and connected to the slider for driving the slider. A lever is pivotally connected to a second end of the shaft for lifting the shaft and the slider to pull the snare of the snare drum.

10 Claims, 4 Drawing Sheets

ADJUST DEVICE FOR ADJUSTING A TENSION OF A SNARE OF A SNARE DRUM

BACKGROUND OF THE INVENTION

1. Field of the Invention

The present invention relates to an adjust device, and more particularly to an adjust device for adjusting a tension of a snare of a snare drum.

2. Description of Related Art

As well know, a snare is mounted and pulled under a snare drum and abuts a bottom the snare drum for making a melodious drumbeat. For elongating the using life of the snare, the tension of the snare released. For quickly releasing or tensioning the snare, a puller is provided to be secured on a periphery of the snare drum and clamping one end of the snare.

A conventional puller for tension a snare of a snare drum in accordance with the prior art usually used a ratchet device or gear for quickly tensioning and position the snare. However, the conventional pull has no adjust function. Consequently, the snare needs to be detached from the puller and secured on the pull again after pulling the snare for adjusting the tension of the snare when the snare is used for a long time and slackened. It is inconvenient and the snare drum may not be used when the user does not find a suitable tool.

The present invention has arisen to mitigate and/or obviate the disadvantages of the conventional puller for tension a snare of a snare drum.

SUMMARY OF THE INVENTION

The main objective of the present invention is to provide an improved adjust device for adjusting a tension of a snare of a snare drum.

To achieve the objective, the adjust device in accordance with the present invention comprises a body laterally secured on a periphery of the snare drum. A slider is movably received in the body and one end of the snare is secured on the slider so that the tension of the snare is adjusted when the slider is moved. An adjuster is partially screwed into the body for adjusting the stroke of the slider. An actuated device includes a shaft having a first end extending through the adjuster and connected to the slider for driving the slider. A lever is pivotally connected to a second end of the shaft for lifting the shaft and the slider to pull the snare of the snare drum.

Further benefits and advantages of the present invention will become apparent after a careful reading of the detailed description with appropriate reference to the accompanying drawings.

DETAILED DESCRIPTION OF THE INVENTION

Figure 1:
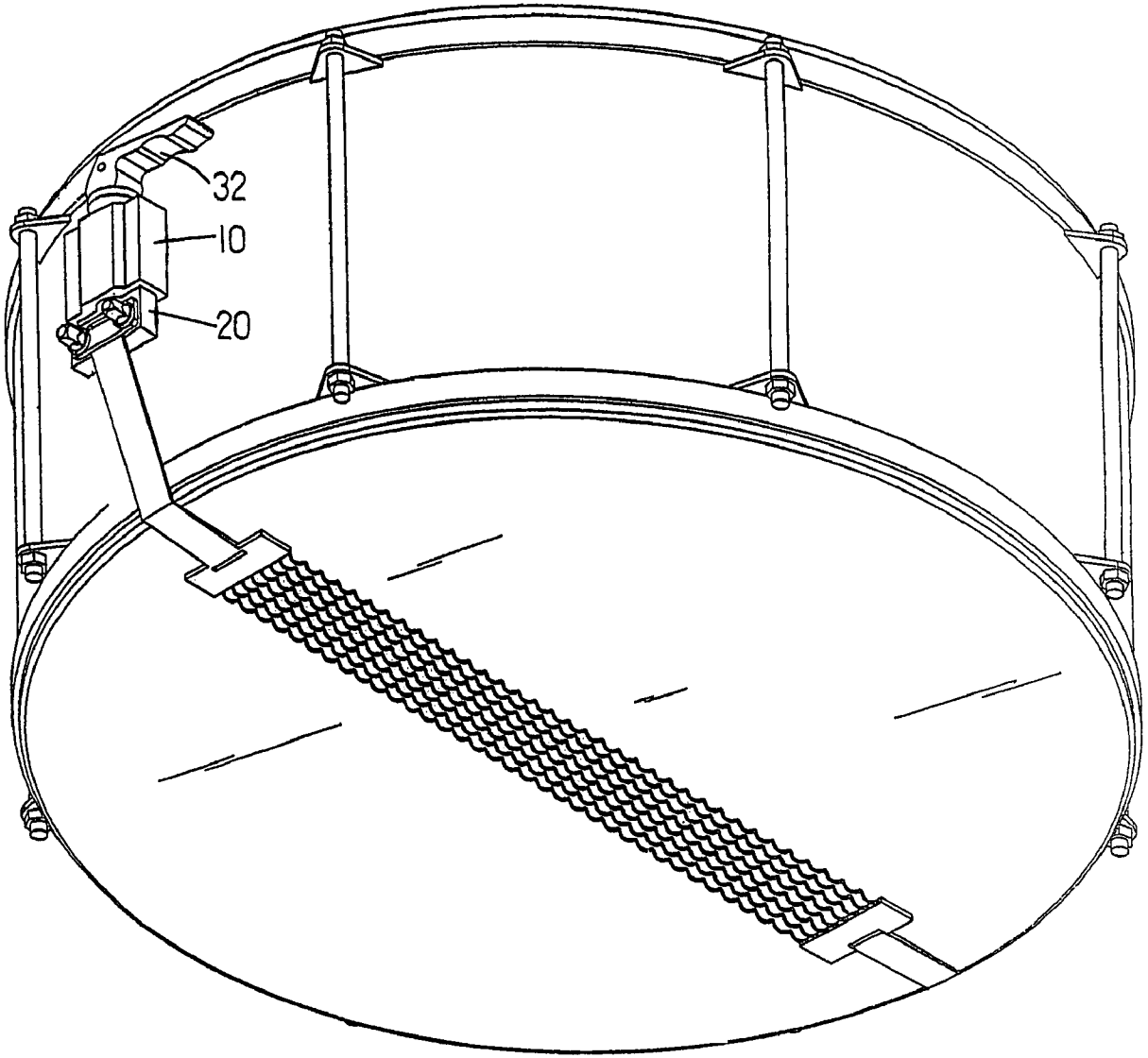
FIG. 1 is a bottom perspective view of a snare drum on which the adjust device for adjusting a tension of a snare in accordance with the present invention is mounted.
Figure 2:
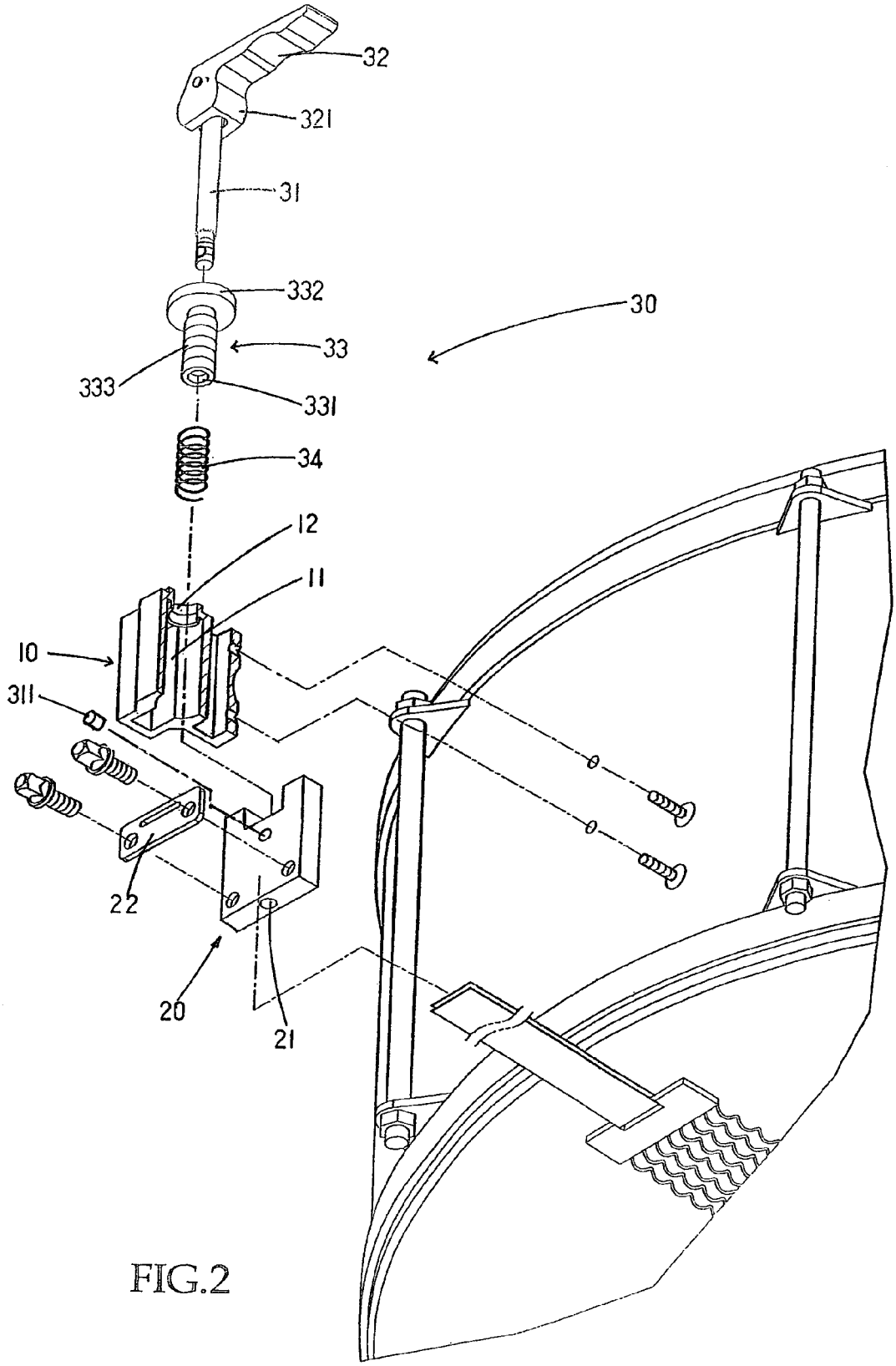
FIG. 2 is an exploded perspective view of the adjust device in FIG. 1.

Referring to the drawings and initially to FIGS. 1 and 2, a adjust device for adjusting a tension of a snare of a snare drum in accordance with the present invention comprises a body (10) laterally secured on a periphery of the snare drum, a slider (20) movably mounted in the body (10) for pulling the snare of the snare drum and a actuated device (30) extending into the body (10) and connected to the slider (20) for driving the slider (20).

The body (10) includes a passage (11) longitudinally defined therein for slidably receiving the slider (20) and a threaded hole (12) defined in a top portion of the body (10) and longitudinally communicating with the passage (11) in the body (10).

The slider (20) includes a threaded hole (21) in a top portion thereof a plate (22) is securely attached to one side of the slider (20). One end of the snare is secured between the slider (20) and the plate (22) so that the snare is tensioned to abut a bottom of the snare drum when the slider (20) is upward moved due to the actuated device (30).

The actuated device (30) includes adjuster (33) mounted to the top portion of the body (10). The adjuster (33) includes an enlarged head (332), and threaded stub (333) extending from the enlarged head (332) and screwed into the threaded hole (12) in the body (10) for adjusting the stroke of the slider (20). The enlarged head (332) has a diameter greater than that of the threaded hole (12) in the body (10) to prevent the adjuster (33) from being overly screwed into the body (10). A through hole (331) is longitudinally defined in the adjuster (33). The actuated device (30) includes a shaft (31) having a first end extending into the body (10) via the through hole (331) in the adjuster (33) and connected to the slider (20). The first end of the shaft (31) is threaded and screwed into the threaded hole (21) in the slider (20) so that the slider (20) is moved with the shaft (31). Further with reference to FIG. 3, a pin (311) laterally extends through the slider (20) into the first end of the shaft (31) to prevent the shaft (31) from being rotated and detaching from the slider (20). A lever (32) is pivotally connected to a second end of the shaft (31) and has a cam (321) is formed on one end of the lever (32) corresponding to the shaft (31). Consequently, the shaft (31) is upwardly lifted and the slider (20) is upwardly moved in the body (10) to pull the snare when the lever (32) is wrenched and the cam (321) abuts the enlarged head (332) of the adjuster (33). A spring (34) is sleeve on the shaft (31) and compressively mounted between the adjuster (33) and the slider (20) to downward push the slider (20) for releasing the tension of the snare when the lever (32) is upwardly wrenched.

Figure 3:
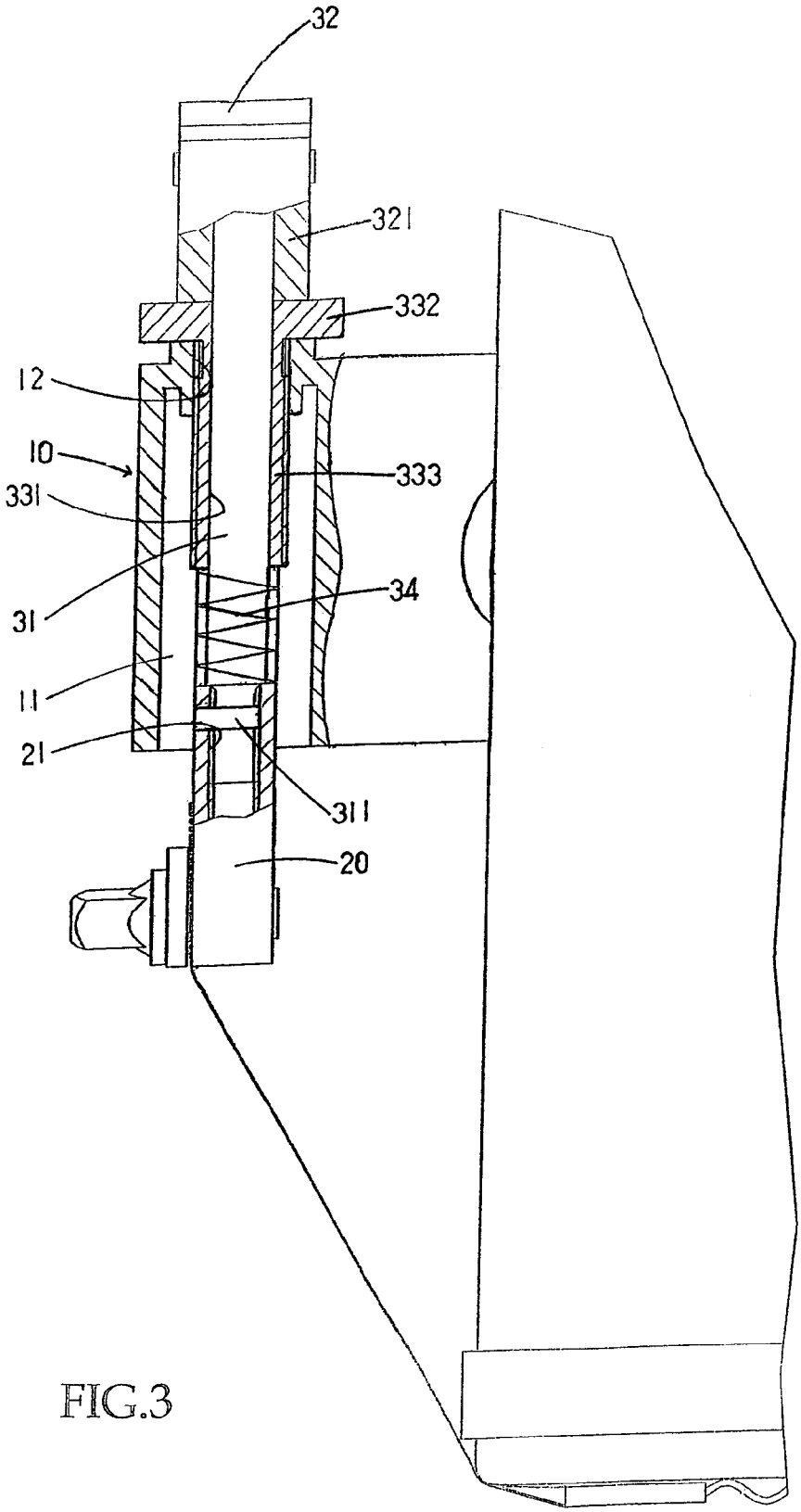
FIG. 3 is a first operational cross-sectional view of the adjust device of the present invention in a short stroke.

With reference to FIG. 3, the adjuster (33) is deeply screwed into the threaded hole (12) in the body (10) to make the enlarged head (332) abut against the top portion of the body (10). Consequently, the stroke of the slider (20) is equal to the diameter of the cam (321) of the lever (32).

Figure 4:
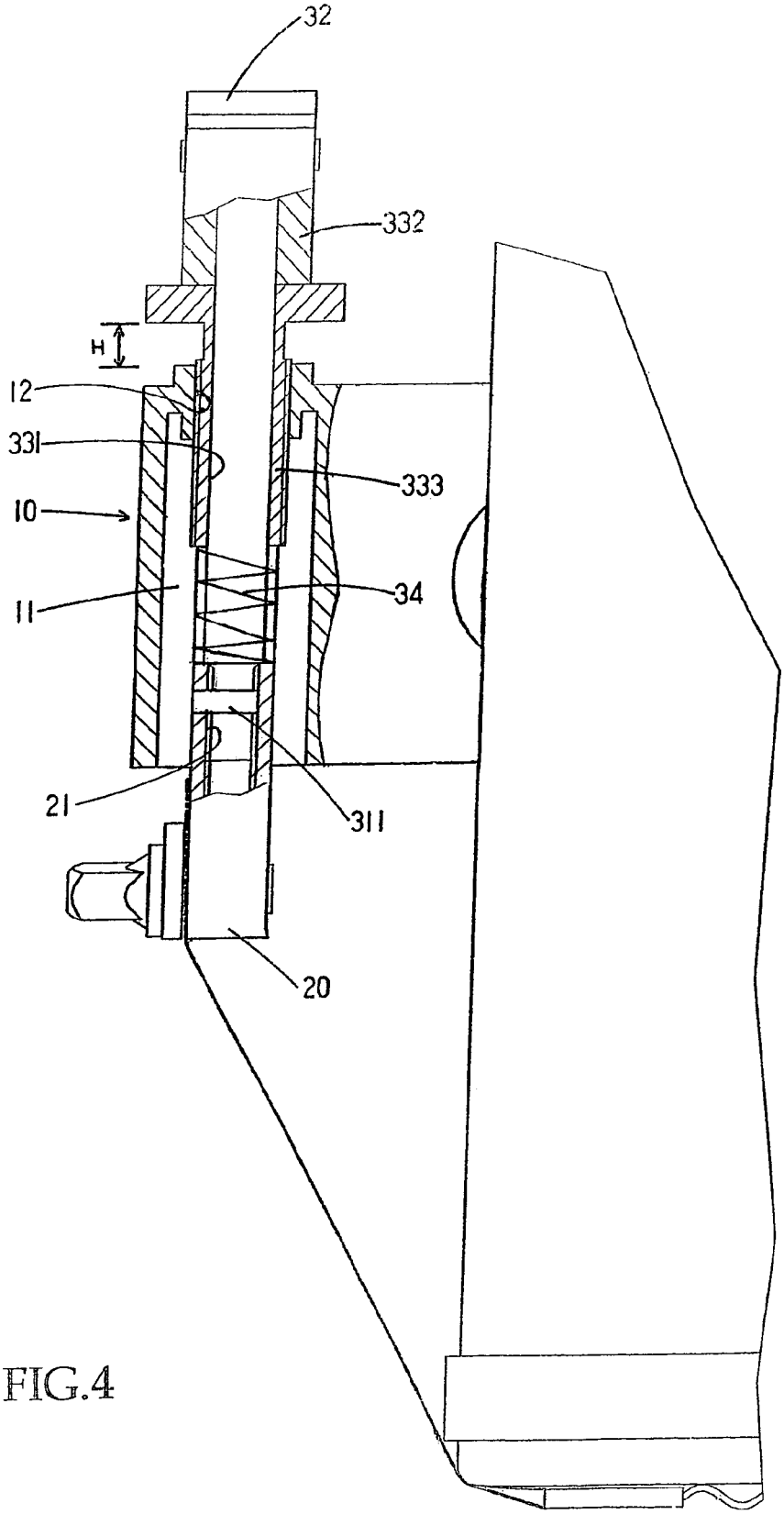
FIG. 4 is a second operational cross-sectional view of the adjust device of the present invention in a long stroke.

With reference to FIG. 4, the adjuster (33) is upwardly moved due to the threaded stub (333) and the through hole (12) in the body (10) and formed a distance (H) between the enlarged head (332) and the body (10). Consequently, the stroke of the slider (20) is equal to the total of the diameter of the cam (321) and the distance (H) between the enlarged head (332) and the body (10).

As described above, the stroke of the slider (20) is adjustable so that the user can easily adjust the tension of the snare without detaching the snare from the adjust device due to the threaded stub (333) and the threaded hole (12) in the body (10). Consequently, the tension of the snare of the snare drum can be adjusted well even if the snare is used for a long time and is slackened.

Although the invention has been explained in relation to its preferred embodiment, it is to be understood that many other possible modifications and variations can be made without departing from the spirit and scope of the invention as hereinafter claimed.

What is claimed is:

1. A adjust device for adjusting a tension of a snare of a snare drum, comprising:

a body adapted to be laterally secured on a periphery of the snare drum, the body having a passage longitudinally defined therein and a threaded hole defined in a top portion of the body, the threaded hole in the body longitudinally communicating with the passage;

a slider movably received in the passage in the body and a plate securely attached to one side of the slider for securely clamping one end of the snare between the slider and the plate;

an adjuster mounted to the top portion of the body, the adjuster including an enlarged head and a threaded stub extending from the enlarged head, the threaded stub screwed into the threaded hole in the body for adjusting a stroke of the slider, a through hole longitudinally defined in the adjuster; and an actuated device extending through the adjuster and the into the body, and connected to a top portion of the slider for driving the slider, the actuated device including a shaft having a first end extending into the body and connected to the top portion of the slider, and a lever pivotally connected to a second end of the shaft, the lever having a cam formed on one end thereof and corresponding to the shaft for lifting the shaft with the slider when the lever is downward wrenched and the cam abuts against the enlarged head of the adjuster.

2. The adjust device as claimed in claim 1, wherein the slider comprises a threaded hole longitudinally defined in the top portion of the slider and the first end of the shaft is threaded so that the first end of the shaft is screwed into the threaded hole in the slider.

3. The adjust device as claimed in claim 1, wherein the actuated device comprises a spring sleeved on the shaft between the adjuster and the top portion of the slider for downward pushing the slider when the lever is upwardly wrenched to release the tension of the snare.

4. The adjust device as claimed in claim 1, wherein the enlarged head has a diameter greater than that of the threaded hole in the body to prevent the adjuster from being overly screwed into the body.

5. The adjust device as claimed in claim 2, wherein the actuated device comprises a pin laterally extending through the slider and inserted into the first end of the shaft to prevent the shaft from being rotated relative to the slider and detaching from the slider.

6. The adjust device as claimed in claim 2, wherein the actuated device comprises a spring sleeved on the shaft between the adjuster and the top portion of the slider for downward pushing the slider when the lever is upwardly wrenched to release the tension of the snare.

7. The adjust device as claimed in claim 5, wherein the actuated device comprises a spring sleeved on the shaft between the adjuster and the top portion of the slider for downward pushing the slider when the lever is upwardly wrenched to release the tension of the snare.

8. The adjust device as claimed in claim 5, wherein the actuated device comprises a spring sleeved on the shaft between the adjuster and the top portion of the slider for downward pushing the slider when the lever is upwardly wrenched to release the tension of the snare.

9. The adjust device as claimed in claim 6, wherein the actuated device comprises a spring sleeved on the shaft between the adjuster and the top portion of the slider for downward pushing the slider when the lever is upwardly wrenched to release the tension of the snare.

10. The adjust device as claimed in claim 7, wherein the actuated device comprises a spring sleeved on the shaft between the adjuster and the top portion of the slider for downward pushing the slider when the lever is upwardly wrenched to release the tension of the snare.

* * * * *